US011118534B2

(12) United States Patent
Ichikawa et al.

(10) Patent No.: US 11,118,534 B2
(45) Date of Patent: Sep. 14, 2021

(54) MULTI-CYLINDER ENGINE

(71) Applicant: MAZDA MOTOR CORPORATION, Hiroshima (JP)

(72) Inventors: Kazuo Ichikawa, Aki-gun (JP); Yoshihisa Nou, Aki-gun (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 16/772,328

(22) PCT Filed: Nov. 27, 2018

(86) PCT No.: PCT/JP2018/043534
§ 371 (c)(1),
(2) Date: Jun. 12, 2020

(87) PCT Pub. No.: WO2019/123992
PCT Pub. Date: Jun. 27, 2019

(65) Prior Publication Data

US 2021/0087999 A1 Mar. 25, 2021

(30) Foreign Application Priority Data

Dec. 19, 2017 (JP) ..... JP2017-243043

(51) Int. Cl.
*F02F 7/00* (2006.01)
*F02F 1/00* (2006.01)
*F02B 75/18* (2006.01)

(52) U.S. Cl.
CPC ..... *F02F 7/0053* (2013.01); *F02F 1/00* (2013.01); *F02B 2075/1816* (2013.01); *F02F 2007/0063* (2013.01)

(58) Field of Classification Search
CPC .... F02F 7/0053; F02F 1/00; F02F 2007/0063; F02B 2075/1816; F02B 7/00; F02B 7/0095
See application file for complete search history.

(56) References Cited

U.S. PATENT DOCUMENTS 4,630,579 A * 12/1986 Atkin ..... F02F 7/0053 123/195 H
4,712,517 A * 12/1987 Anno ..... F02F 1/108 123/195 R (Continued)

FOREIGN PATENT DOCUMENTS

JP S58077140 U 5/1983
JP H03114557 U 11/1991

(Continued)

OTHER PUBLICATIONS

International Search Report issued in PCT/JP2018/043534; dated Jan. 8, 2019.

(Continued)

*Primary Examiner* — Syed O Hasan
(74) *Attorney, Agent, or Firm* — Studebaker & Brackett PC

(57) ABSTRACT

An engine includes an output shaft, a cylinder head, a cylinder block, and a plurality of head bolts. The cylinder block includes three or more cylinder parts, a plurality of connecting portions, a plurality of output shaft supporting parts, and a plurality of head bolt holes. A side wall face of at least one cylinder part includes a first rib. The first rib diagonally extends from the connecting portion toward a head bolt hole base.

20 Claims, 9 Drawing Sheets

(56) References Cited

U.S. PATENT DOCUMENTS

| | | | | |
|---|---|---|---|---|
| 6,082,320 | A * | 7/2000 | Shimayama | F02F 1/108 123/193.1 |
| 9,719,462 | B2 | 8/2017 | Lavazza | |
| 2006/0249116 | A1 | 11/2006 | Liebert | |

FOREIGN PATENT DOCUMENTS

| | | | |
|---|---|---|---|
| JP | H04011241 | U | 1/1992 |
| JP | H07247899 | A | 9/1995 |
| JP | 1998047152 | * | 7/1996 |
| JP | 1998318040 | * | 12/1998 |
| JP | H10318040 | A | 12/1998 |
| JP | 2005201115 | A | 7/2005 |
| JP | 2006336612 | A | 12/2006 |
| WO | 2016063445 | A1 | 4/2016 |

OTHER PUBLICATIONS

An Office Action issued by the German Patent and Trade Mark Office dated May 21, 2021, which corresponds to German Patent Application No. 11 2018 005 812.3 and is related to U.S. Appl. No. 16/772,328; with English language translation.

* cited by examiner

MULTI-CYLINDER ENGINE

TECHNICAL FIELD

The present invention relates to a multi-cylinder engine, in particular, a structure of a cylinder block.

BACKGROUND ART

An engine of a vehicle includes a cylinder block including a plurality of cylinders, and a cylinder head attached to an upper side of the cylinder block. The cylinder head is attached to the cylinder block with a plurality of head bolts.

It is important for the engine to have high sealability at a contacting portion between the cylinder head and the cylinder block to prevent leakage of gas, liquid coolant, oil, or the like. Patent Literature 1 discloses a technique of providing endless recess and protrusion on a contact face, which contacts the cylinder head, of the cylinder block to obtain such sealability. In the technique proposed in Patent Literature 1, the cylinder head makes contact with a top of the protrusion formed on the contact face, which contacts the cylinder head, of the cylinder block and thereby creates a high contact pressure, which is advantageous in obtaining sealability.

CITATION LIST

Patent Literature

Patent Literature 1: JP 2005-201115 A

SUMMARY OF INVENTION

However, in the technique proposed in Patent Literature 1, the recess and the protrusion are formed to encircle the entire circumference of a bore opening of the cylinder block, so that sealability may differ between a region near a fastener portion fastened by a head bolt and a region far from the fastener portion. That is, a high compressional stress is created between the cylinder head and the cylinder block in the region near the fastener portion while a relatively low compressional stress is created in the region far from the fastener portion, which means that high sealability is obtained in the region near the fastener portion while a relatively low sealability is obtained in the region far from the fastener portion.

The present invention has been made to solve such a problem. An object of the present invention is to provide a multi-cylinder engine that has high sealability between the cylinder block and the cylinder head regardless of a distance from a portion where the head bolt hole is provided.

A multi-cylinder engine according to one aspect of the present invention includes an output shaft of the multi-cylinder engine, a cylinder head, a cylinder block attached to the cylinder head, and a plurality of head bolts for fastening together the cylinder block and the cylinder head. The cylinder block includes three or more cylinder parts each extending in a direction perpendicular to the output shaft and including a cylinder formed in the cylinder part, the three or more cylinder parts being formed in series, a plurality of connecting portions each provided at a portion where the cylinder parts adjacent along the output shaft axial direction are joined to each other, the connecting portions being disposed in a side opposite to the cylinder head in a cylinder axial direction, a plurality of output shaft supporting parts each provided on one of the plurality of connecting portions to extend in a side opposite to the cylinder part in the cylinder axial direction, each of the plurality of output shaft supporting parts including a portion that supports the output shaft, and a plurality of head bolt holes each provided in a portion of a side wall of the three or more cylinder parts, the portion being where the cylinder parts adjacent along the output shaft axial direction are joined to each other, the head bolt holes extending in the cylinder axial direction from a contact face, which contacts the cylinder head, toward the connecting portion, the plurality of head bolts being inserted in the plurality of head bolt holes, and wherein a side wall face of at least one of the three or more cylinder parts includes a first rib extending diagonally to the cylinder axial direction toward the cylinder head, the first rib having a proximal end on the connecting portion provided in one side, in the output shaft axial direction, of the cylinder part and extending to the head bolt hole provided in the other side, in the output shaft axial direction, of the cylinder part.

DESCRIPTION OF EMBODIMENTS

Figure 1:
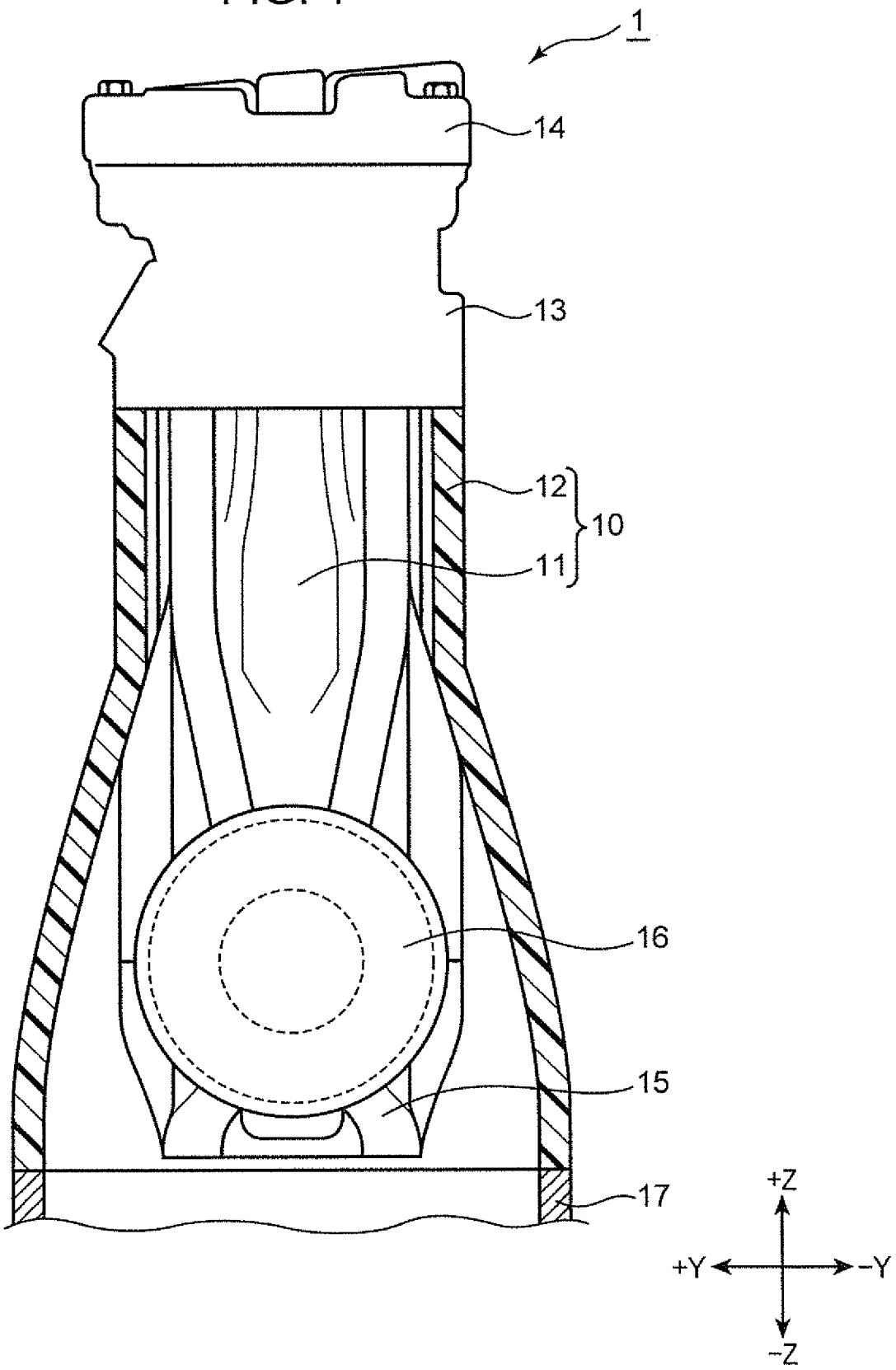
FIG. 1 is a schematic front view (with a partial sectional view) illustrating a schematic configuration of an engine according to an embodiment.

An embodiment of the present invention will be described with reference to the drawings. It should be noted that the embodiment described below is an example of the present invention. The scope of the present invention is not limited to the embodiment described below except for an essential configuration.

In the drawings described below, X direction is an output shaft axial direction, Y direction is an intake and exhaust direction, and Z direction is a cylinder axial direction.

Embodiment

1. General Configuration of Engine 1

A configuration of an engine 1 will be described with reference to FIGS. 1 and 2.

The engine 1 according to the present embodiment is an exemplary four-cylinder gasoline engine. As illustrated in FIG. 1, the engine 1 includes a cylinder block 10, a cylinder head 13, a head cover 14, a bearing cap (cap part) 15, a crank shaft (output shaft) 16, and an oil pan 17.

The cylinder block 10 includes a block core 11 formed using a metal material, and a cylinder block outer wall 12 formed using a resin material. Details on the block core 11 will be described later.

The cylinder block outer wall 12 surrounds the block core 11, the bearing cap 15, and a portion of the crank shaft 16. The oil pan 17 is joined to a −Z portion of the cylinder block outer wall 12. Although not illustrated in detail in FIG. 1, a water jacket, which is a passage through which a liquid coolant flows, is formed in the cylinder block outer wall 12.

The cylinder head 13 is attached to a +Z portion of the cylinder block 10. Although not illustrated in FIG. 1, the cylinder head 13 includes a cam shaft, an intake/exhaust valve, and an intake/exhaust manifold.

The head cover 14 is attached to a +Z portion of the cylinder head 13 to plug a +Z opening of the cylinder head 13.

The bearing cap (cap part) 15 is attached to a −Z portion of the block core 11. The bearing cap 15 and the block core 11 rotatably support the crank shaft 16.

Figure 2:
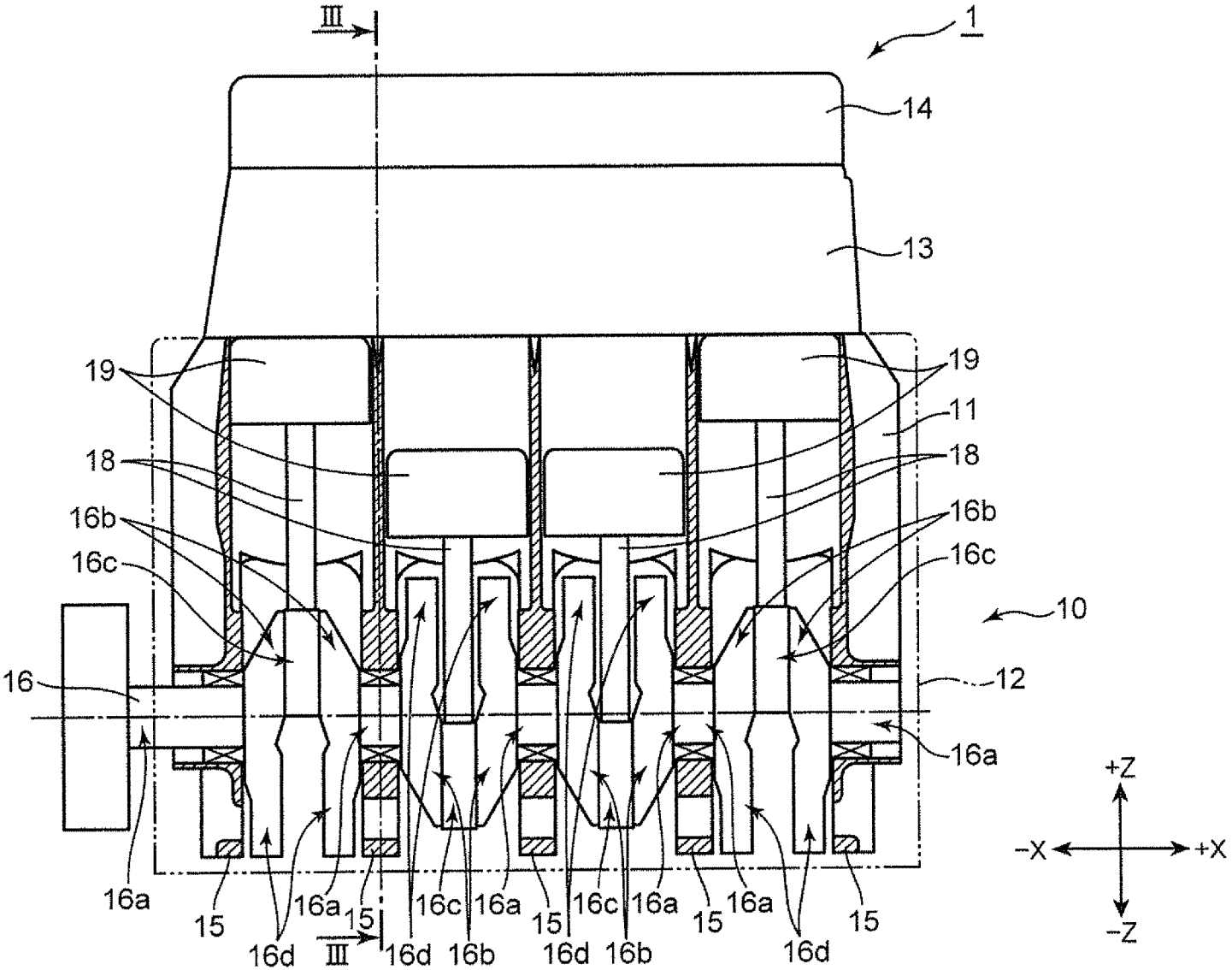
FIG. 2 is a schematic side view illustrating the schematic configuration of the engine.

As illustrated in FIG. 2, the crankshaft 16 extends in X direction. The crank shaft 16 includes crank journals 16*a* supported by the block core 11 and the bearing cap 15, crank arms 16*b* each provided between the crank journals 16*a* adjacent along X direction, crank pins 16*c* each provided between a pair of crank arms 16*b* adjacent along X direction, counter weights 16*d* each continuing from one of the crank arms 16*b*.

A con rod (connecting rod) 18 is rotatably attached to each crank pin 16*c*, and a piston 19 is attached to the other end of the con rod 18. The piston 19 can reciprocate along Z direction inside the cylinder. The crank shaft 16 rotates along with reciprocation of the piston 19.

2. Configuration of Assembly of Cylinder Head 13, Block Core 11, and Bearing Cap 15

Figure 3:
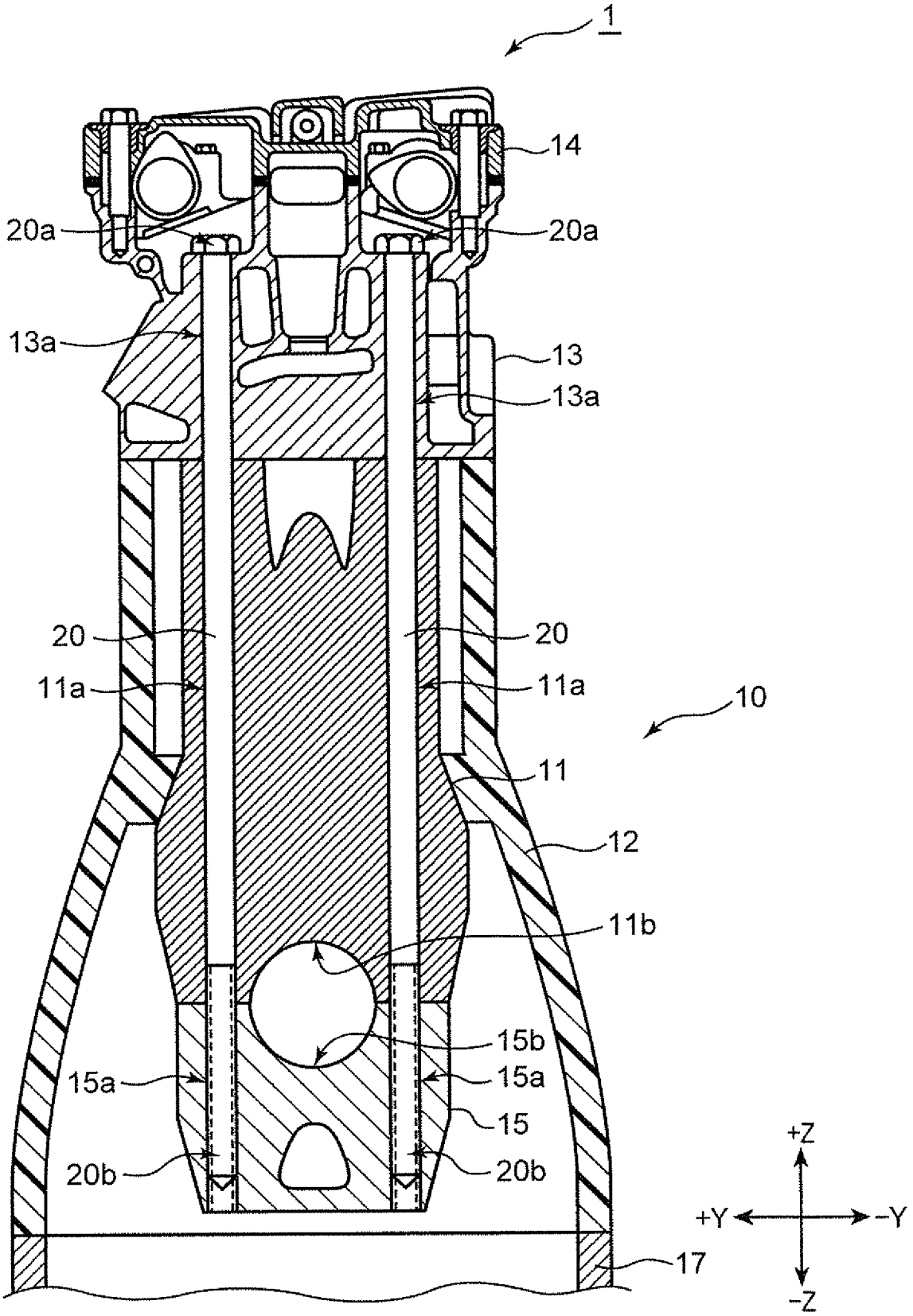
FIG. 3 is a schematic sectional view taken along line III-III in FIG. 2, illustrating a configuration of an assembly of a cylinder head, a block core, and a bearing cap.

A configuration of an assembly of the cylinder head 13, the block core 11, and the bearing cap 15 will be described with reference to FIG. 3. FIG. 3 is a schematic sectional view taken along line III-III in FIG. 2.

As illustrated in FIG. 3, a plurality of head bolt holes 11*a* are provided in the block core 11. A plurality of the head bolt holes 11*a* form pairs of holes, where each of the pairs is provided across Y direction. The head bolt holes 11*a* penetrate the block core 11 in Z direction, and run through portions beyond edges in Y direction (radially outside portions) of a bearing part 11*b* in which the crank shaft 16 is disposed.

A plurality of head bolt holes 13*a* are provided in the cylinder head 13. A plurality of the head bolt holes 13*a* in the cylinder head 13 each communicates with one of the head bolt holes 11*a* in the block core 11. A plurality of the head bolt holes 13*a* penetrate the cylinder head 13 in Z direction.

The bearing cap 15 includes a plurality of threaded holes 15*a* provided in portions beyond edges in Y direction (radially outside portions) of a bearing part 15*b* in which the crank shaft 16 is disposed. Each of the threaded holes 15*a* communicates with one of the head bolt holes 11*a* in the block core 11. A plurality of the threaded holes 15*a* penetrate the bearing cap 15 in Z direction.

In the engine 1, a plurality of the head bolts 20 are inserted, from +Z side of the cylinder head 13, in the head bolt hole 13*a* and the head bolt hole 11*a*, and a threaded portion 20*b* provided to each of −Z distal end portions of the head bolts 20 is screwed in a female thread of one of the threaded holes 15*a* in the bearing cap 15.

As illustrated in FIG. 3, in the engine 1 according to the present embodiment, the cylinder head 13, the block core 11, and the bearing cap 15 are fastened together with the head bolts 20. Thus, in the engine 1, the cylinder head 13 and the block core 11 are held (or clamped) between bolt heads 20*a* of the head bolts 20 and screwed portions where the threaded portions 20*b* are screwed in the threaded holes 15*a* in the bearing cap 15. In more detail, the block core 11 is held between the cylinder block 13 and the bearing cap 15 along Z direction.

FIG. 3 illustrates an exemplary section of the engine 1 (section taken along line III-III in FIG. 2). Other fastener portions fastened with the head bolt 20 have a similar configuration.

3. Configuration of Block Core 11 and Bearing Cap 15

Figure 4:
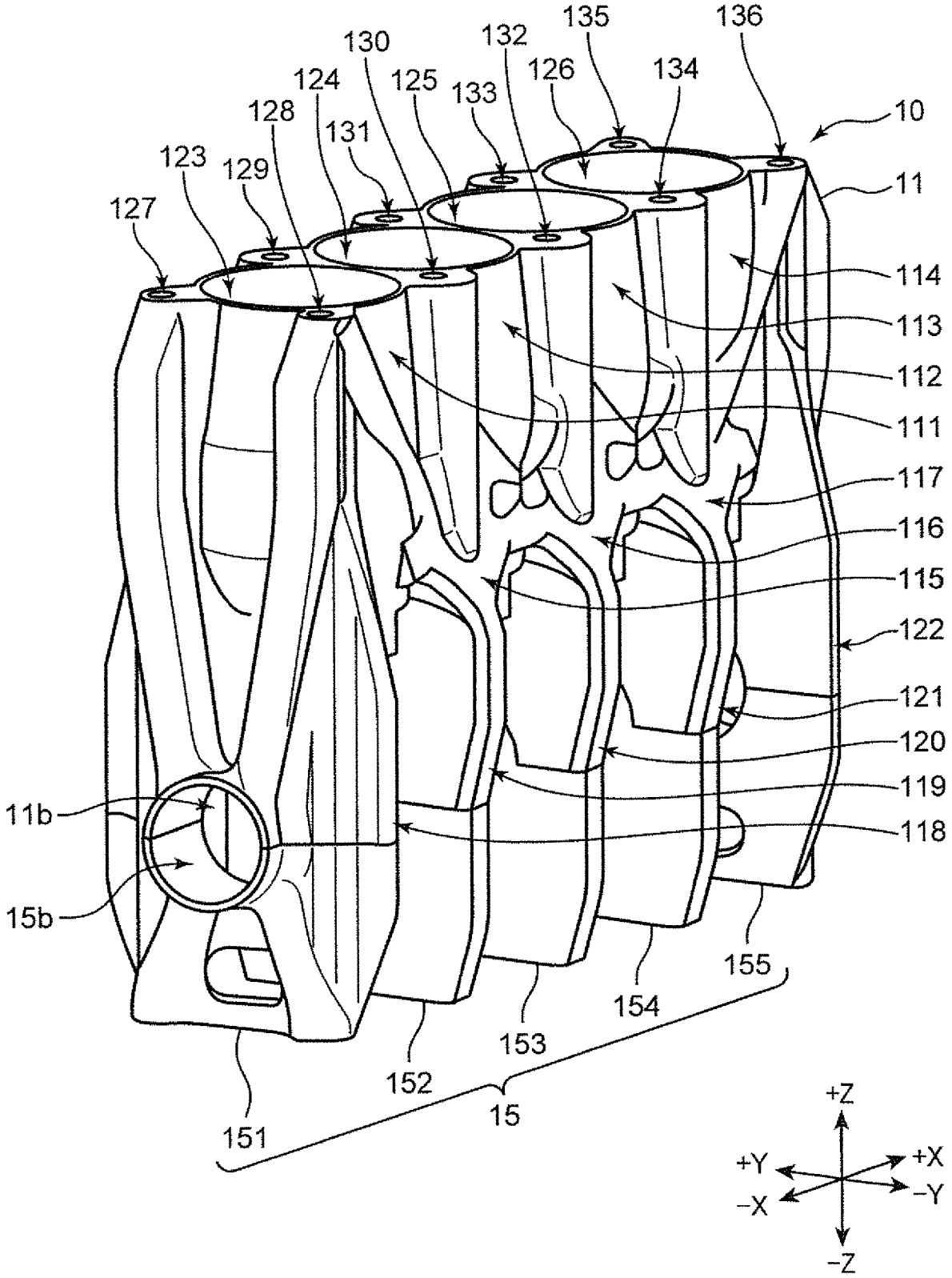
FIG. 4 is a schematic perspective view illustrating a configuration of the block core and the bearing cap.
Figure 5:
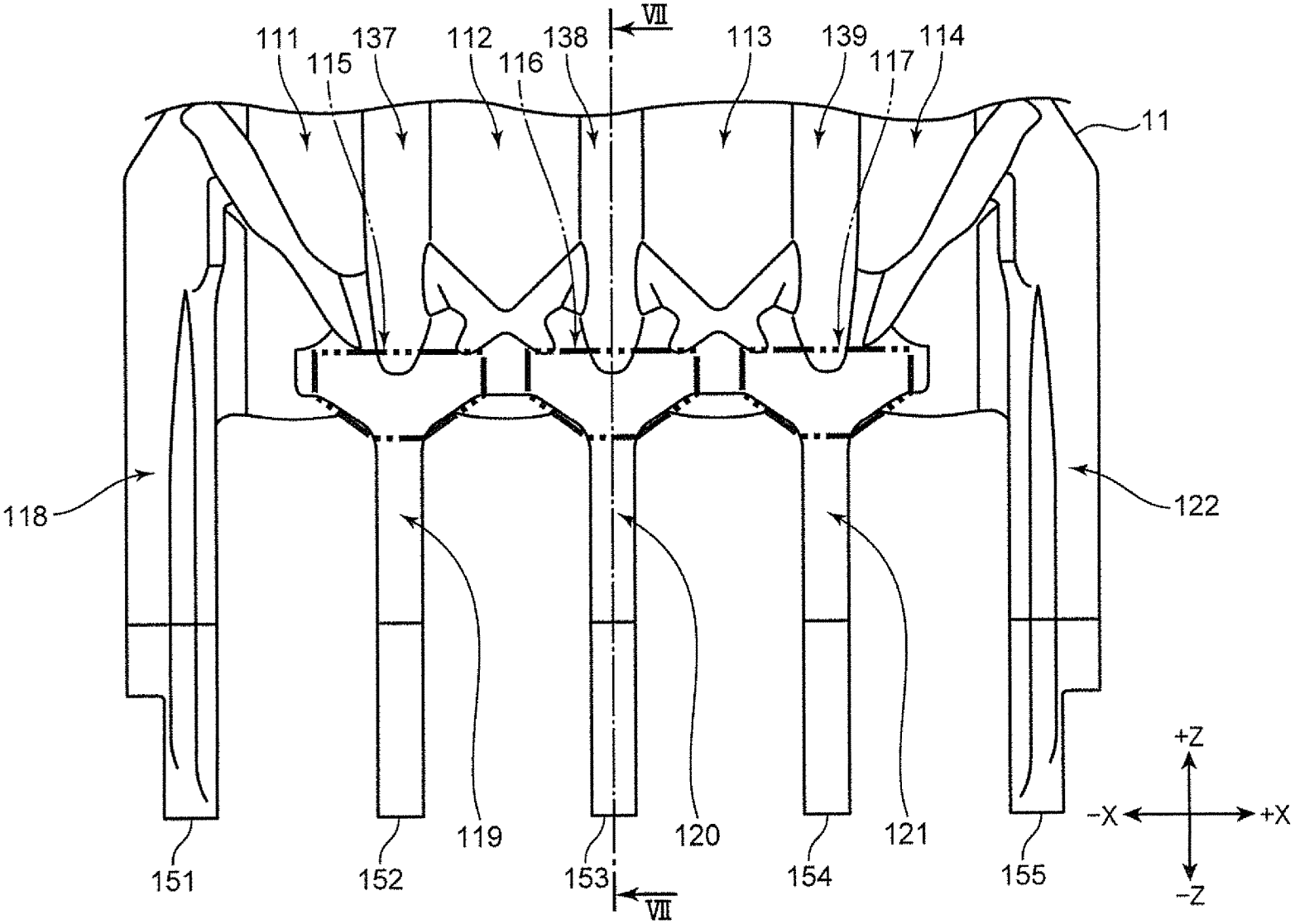
FIG. 5 is a schematic side view illustrating a configuration of the block core and the bearing cap.

A configuration of the block core 11 and the bearing cap 15 will be described with reference to FIGS. 4 and 5. FIG. 4 is a schematic perspective view and FIG. 5 is a schematic side view, each illustrating the configuration of the block core 11 and the bearing cap 15.

As illustrated in FIG. 4, the block core 11 of the cylinder block 10 includes four cylinder parts 111 to 114, three connecting portions 115 to 117, and five shaft supporting parts (output shaft supporting parts) 118 to 122. The four cylinder parts 111 to 114, the three connecting portions 115 to 117, and the five shaft supporting parts 118 to 122 of the block core 11 are integrally formed using a metal material.

The four cylinder parts 111 to 114 respectively include cylinders 123 to 126. The cylinders 123 to 126 are arranged along X direction. Hereinafter, among the four cylinder parts 111 to 114, the cylinder parts 112 and 113 other than the cylinder parts 111 and 114 which are disposed at ends in X direction may each be referred to as an inner cylinder part.

A plurality of head bolt holes 127 to 136 are provided to penetrate the block core 11 in Z direction. Among a plurality of the head bolt holes 127 to 136, the head bolt holes 127, 129, 131, 133, and 135 are provided in a +Y side wall of the block core 11, and the head bolt holes 128, 130, 132, 134, and 136 are provided in a −Y side wall of the block core 11.

The head bolt holes 129 to 134 are each provided in a portion between two cylinders adjacent along X direction among the cylinders 123 to 126. The head bolt holes 127, 128, 135, and 136 are provided in outer sides in X direction of the cylinders 123 and 126.

With respect to Y direction, the head bolt hole 127 and the head bolt hole 128 form a pair, the head bolt hole 129 and the head bolt hole 130 form a pair, the head bolt hole 131 and the head bolt hole 132 form a pair, the head bolt 133 and the head bolt 134 form a pair, and the head bolt 135 and the head bolt 136 form a pair.

As illustrated in FIG. 5, the connecting portion 115 is provided in a −Z portion (joint portion) between the cylinder part 111 and the cylinder part 112 adjacent to each other along X direction. The connecting portion 116 is provided in a −Z portion (joint portion) between the cylinder part 112 and the cylinder part 113 adjacent to each other along X direction. The connecting portion 117 is provided in a −Z portion (joint portion) between the cylinder part 113 and the cylinder part 114 adjacent to each other along X direction.

The shaft supporting parts 119 to 121 extend in −Z side from −Z portions of the connecting portions 115 to 117.

On the other hand, the shaft supporting parts 118 and 122 extends in −Z side from outer portions in X direction of the cylinder parts 111 and 114.

As illustrated in FIG. 5, head bolt hole bases 137 to 139 are provided on the side wall face of the block core 11. The head bolt hole bases 137 to 139 are formed on +Z portions of the connecting portions 115 to 117. The head bolt hole bases 137 to 139 each has a form of a circular-column rib protruding toward a near side of FIG. 5 (toward −Y side). The head bolt hole 130 is provided in the head bolt hole base 137, the head bolt hole 132 is provided in the head bolt hole base 138, and the head bolt hole 134 is provided in the head bolt hole base 139.

FIG. 5 illustrates only a −Y side wall face of the block core 11. A head bolt hole base is formed in a similar manner also on a +Y side wall face on the opposite side.

As illustrated in FIGS. 4 and 5, bearing caps 151 to 155 are attached to −Z portions of the shaft supporting parts 118 to 122. The bearing caps 151 to 155 are collectively referred to as "bearing cap 15".

The bearing caps 151 to 155 are attached to the shaft supporting parts 118 to 122 by fastening with the head bolts 20 as described with reference to FIG. 3. A compressional stress created by fastening with the head bolts 20 screwed in the female threads of the threaded holes 15*a* of the bearing cap 15 (the bearing caps 151 to 155) acts toward +Z side.

4. Configuration of Side Wall Faces of Cylinder Parts 112 and 113

Figure 6:
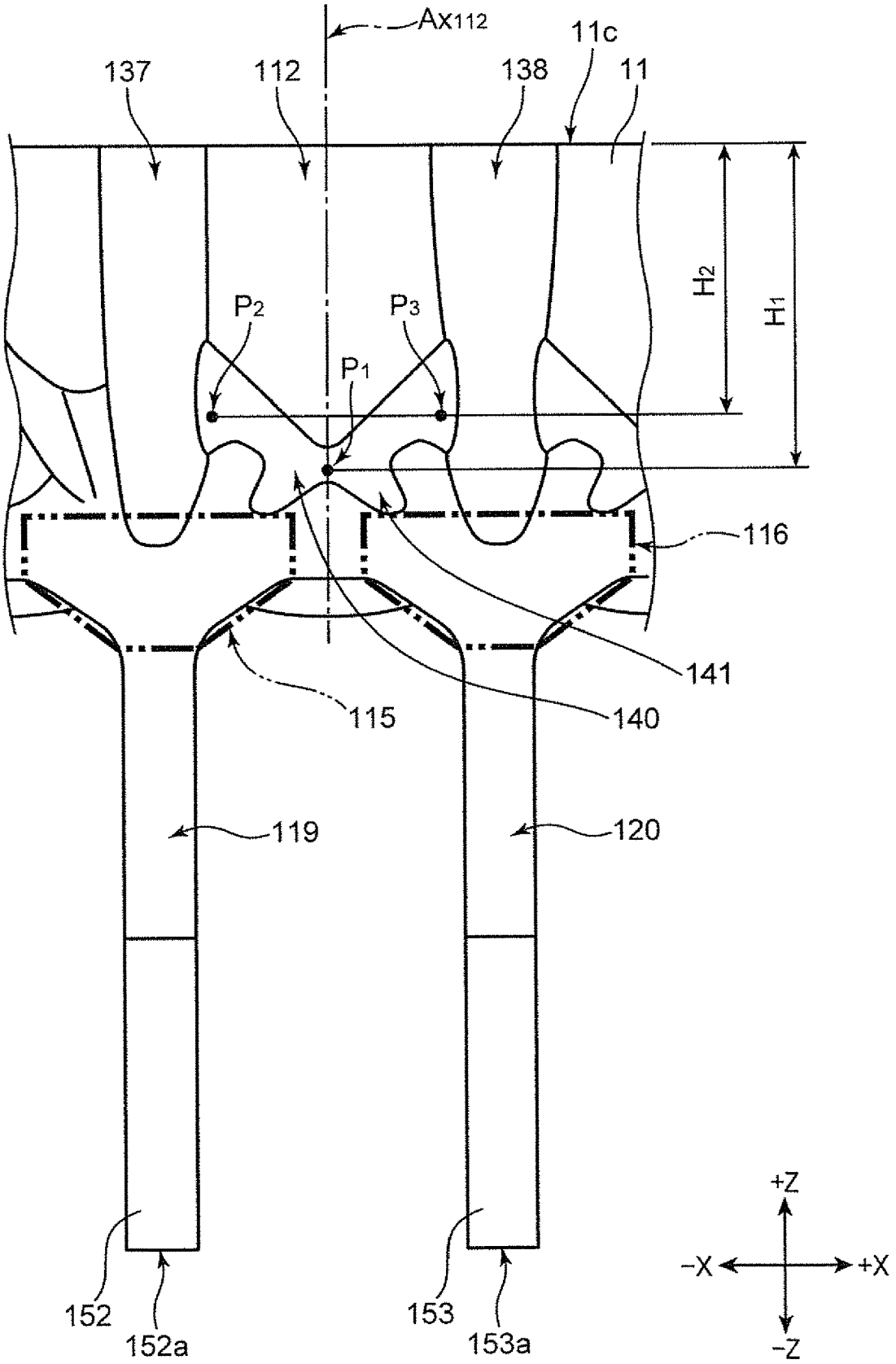
FIG. 6 is a schematic side view illustrating a portion in FIG. 5 in an enlarged manner.

A configuration of the side wall faces of the inner cylinder parts 112 and 113 will be described with reference to FIG. 6. In FIG. 6, the inner cylinder part 112 is illustrated as an example. The side wall face of the inner cylinder part 113 has a similar configuration.

As illustrated in FIG. 6, the side wall face of the inner cylinder part 112 (wall face on a near side of FIG. 6) is provided with diagonal ribs 140 and 141 which are diagonal to both X direction and Z direction. The diagonal rib 140 serves as a first rib, and the diagonal rib 141 serves as a second rib.

The diagonal rib 140 has a proximal end on the connecting portion 115 and diagonally extends in +X and +Z side. The diagonal rib 141 has a proximal end on the connecting portion 116 and diagonally extends in −X and +Z side. In the block core 11 according to the present embodiment, the diagonal rib 140 and the diagonal rib 141 are in a line-symmetric relationship about a central axis (cylinder central axis) $Ax_{112}$ of the cylinder 124 (see FIG. 4) of the inner cylinder part 112, the central axis $Ax_{112}$ extending in Z direction.

The diagonal rib 140 is joined to the head bolt hole base 138 at a junction point $P_3$ in +Z side. The diagonal rib 141 is joined to the head bolt hole base 137 at a junction point $P_2$ in +Z side.

In the block core 11 according to the present embodiment, the junction points $P_2$ and $P_3$ are at a distance $H_2$ in −Z side from the contact face 11*c*, which contacts the cylinder head 13, of the block core 11. That is, the junction points $P_2$ and $P_3$ are closer to the connecting portions 115 and 116 (further in −Z side) than to the contact face 11*c*.

The diagonal rib 140 and the diagonal rib 141 intersect each other at an intersection point $P_1$. The intersection point $P_1$ is on a cylinder central axis $Ax_{112}$ of the inner cylinder part 112. The intersection point $P_1$ is at a distance $H_1$ in −Z side from the contact face 11*c*, which contacts the cylinder head 13, of the block core 11 of the cylinder block 10. That is, the intersection point $P_1$ is located lower (further in −Z side) than the contact face 11*c*.

The block core 11 has diagonal ribs 140 and 141 having a similar form as described above provided on aside wall face, which is on a far side of FIG. 6, of the cylinder part 112. The same can be applied to the cylinder part 113.

5. Configuration of Bearing Caps 151 to 155

Figure 7:
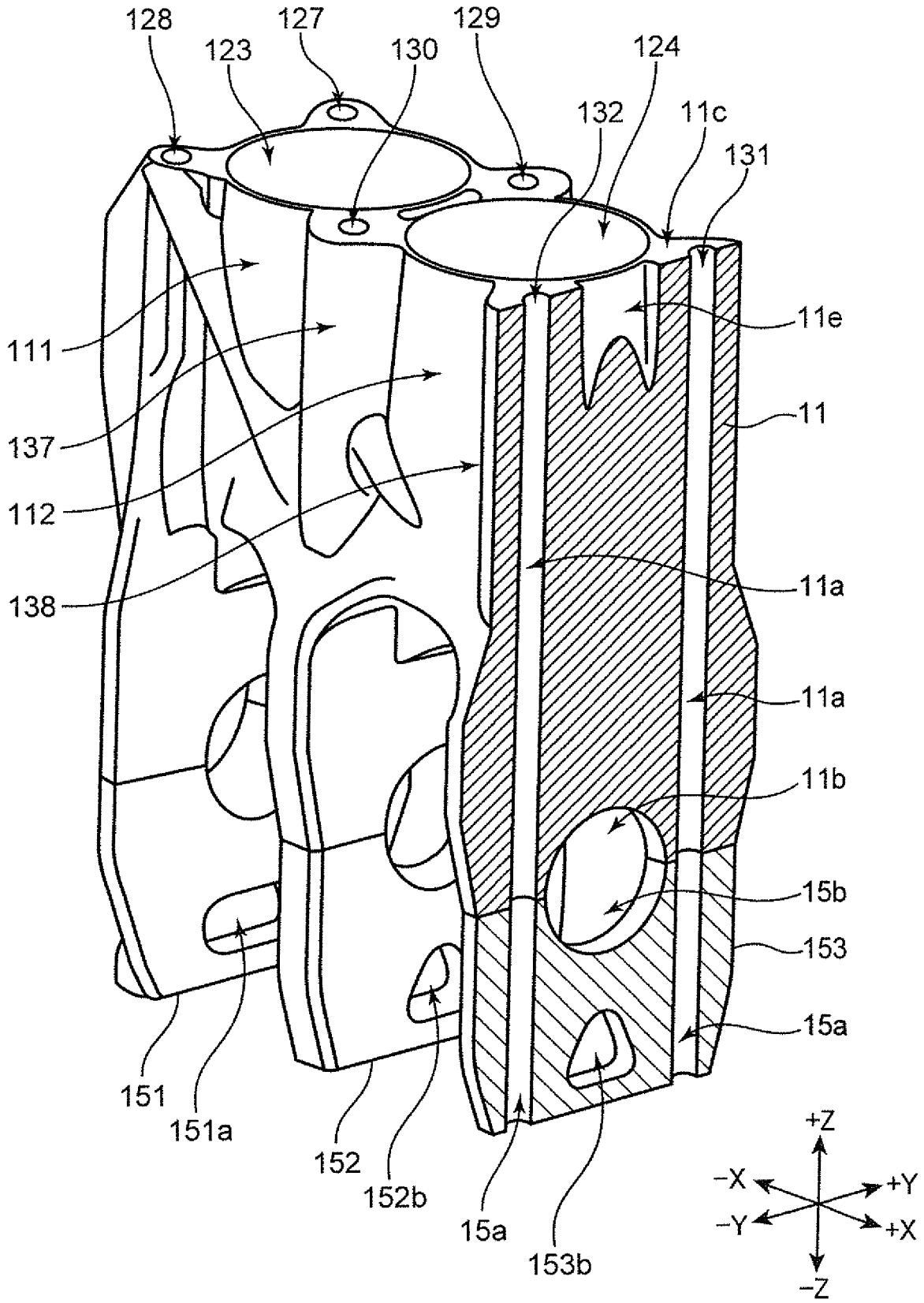
FIG. 7 is a schematic sectional view taken along line VII-VII in FIG. 5, illustrating the configuration of the block core and the bearing cap.

A configuration of the bearing caps 151 to 155 will be described with reference to FIGS. 6 and 7. FIG. 7 is a schematic sectional view taken along line VII-VII in FIG. 5.

As illustrated in FIG. 6, the bearing caps 152 and 153 are attached to the shaft supporting parts 119 and 120 by +Z end portions. The lower end portions (−Z end portions) 152*a* and 153*a* of the bearing caps 152 and 153 are not connected to the bearing caps 151 to 154 adjacent along X direction. Namely, the lower end portions 152*a* and 153*a* are free ends. Other bearing caps 151, 154, and 155 have a similar configuration.

The lower end portions of the bearing caps 151 to 155 are left as free ends, since a cylinder block outer wall 12 made of a resin material is used. The present embodiment employs the cylinder block outer wall 12 formed using a resin material but does not employ a configuration in which the bearing caps 151 to 155 are connected by a beam (for example, a bearing beam, a bearing cap bridge, a ladder frame or the like) in order to reduce the weight of the engine 1.

As illustrated in FIG. 7, an aperture 151*a* is provided in a −Z portion of the bearing cap 151 in −X side. The aperture 151*a* is a hole penetrating the bearing cap 151 in a thickness direction (X direction). The aperture 151*a* has a shape of an oval or an ellipse in a front view viewed along X direction. Although not illustrated in FIG. 7, the bearing cap 155 in +X side is also provided with a similar aperture.

The bearing caps 152 and 153 are also provided with apertures 152*b* and 153*b*. Each of the apertures 152*b* and 153*b* is also a hole penetrating the bearing cap 152 or 153 in a thickness direction (X direction). Each of the apertures 152*b* and 153*b* has a shape of an isosceles triangle with round corners in the front view viewed along X direction.

Although not illustrated in FIG. 7, the bearing cap 154 is also provided with a similar aperture.

6. Effect of Compressional Stress on Block Core 11

Figure 8:
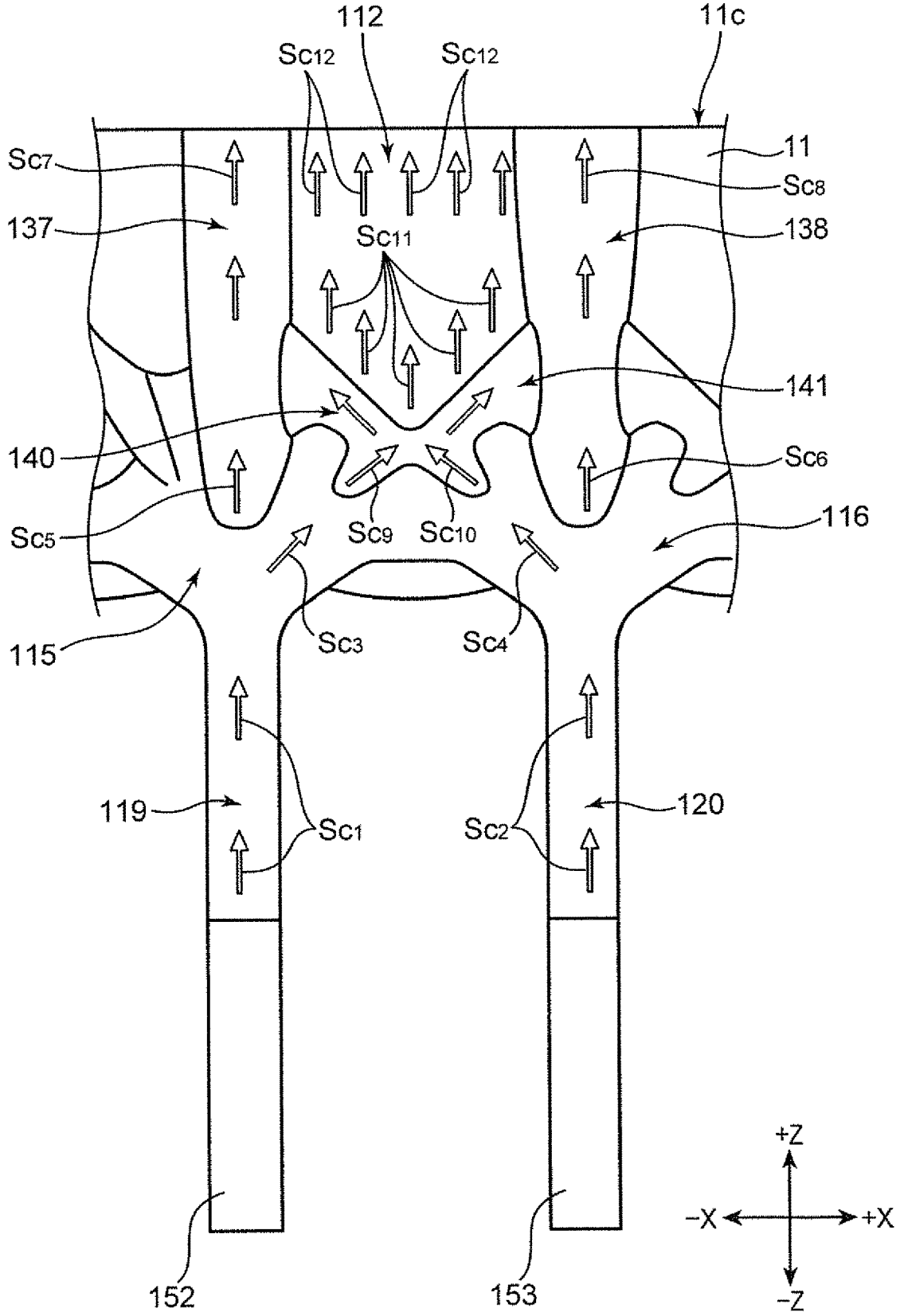
FIG. 8 is a schematic view for describing a compressional stress created by screwing the head bolt to act on the block core.

An effect of a compressional stress that acts on the block core 11 will be described with reference to FIG. 8. FIG. 8 is a schematic view for describing the compressional stress acting on the block core 11.

As illustrated with reference to FIG. 3, in the engine 1 according to the present embodiment, the cylinder head 13, the block core 11, and the bearing cap 15 are fastened together with the head bolts 20. The block core 11 is held between the cylinder head 13 and the bearing cap 15 along Z direction.

As illustrated in FIG. 8, the compressional stress created by fastening acts in a direction toward +Z side from the bearing cap 15 (152 and 153) to the shaft supporting parts 119 and 120 (compressional stresses $Sc_1$ and $Sc_2$). The compressional stress $Sc_1$ acts on the connecting portion 115. The compressional stress $Sc_1$ is distributed by the connecting portion 115 toward the inner cylinder part 112 and the head bolt hole base 137 (compressional stresses $Sc_3$ and $Sc_5$).

Similarly, the compressional stress $Sc_2$ acts on the connecting portion 116. The compressional stress $Sc_2$ is distributed by the connecting portion 116 toward the inner cylinder part 112 and the head bolt hole base 138 (compressional stresses $Sc_4$ and $Sc_6$).

The compressional stress $Sc_5$ is transferred to the head bolt hole base 137 to act on the contact face 11*c*, which contacts the cylinder head 13, of the block core 11 (compressional stress $Sc_7$). The compressional stress $Sc_6$ is transferred to the head bolt hole base 138 to act on the contact face 11*c*, which contacts the cylinder head 13, of the block core 11 (compressional stress $Sc_8$).

The compressional stress $Sc_3$ is transferred along the diagonal rib 141, and the compressional stress $Sc_4$ is transferred along the diagonal rib 140 (compressional stresses $Sc_9$ and $Sc_{10}$). The compressional stresses $Sc_9$ and $Sc_{10}$ are distributed along a circumferential direction (X direction in FIG. 8) of the inner cylinder part 112 (compressional stresses $Sc_{11}$).

The diagonal rib 140 and the diagonal rib 141 of the block core 11 intersect each other. The compressional stress $Sc_4$ and the compressional stress $Sc_{10}$ once concentrate at the intersection point $P_1$ (see FIG. 6) Even if there is a variation between the compressional stress $Sc_9$ and the compressional stress $Sc_{10}$, the compressional stress $Sc_9$ and the compressional stress $Sc_{10}$ concentrated at the intersection point $P_1$ are uniformly distributed as the compressional stress $Sc_{11}$.

The distributed compressional stress $Sc_{11}$ is transferred toward +Z side and acts on the contact face 11*c*, which contacts the cylinder head 13, of the block core 11 (compressional stress $Sc_{12}$).

Although FIG. 8 illustrates only the distribution of the compressional stress in the cylinder part 112, the compressional stress is distributed in a similar manner in the cylinder part 113.

The compressional stress is distributed in a similar manner in a side wall face opposite to the side wall face illustrated in FIG. 8.

7. Transfer of Force Created by Rotation of Crank Shaft 16

Figure 9:
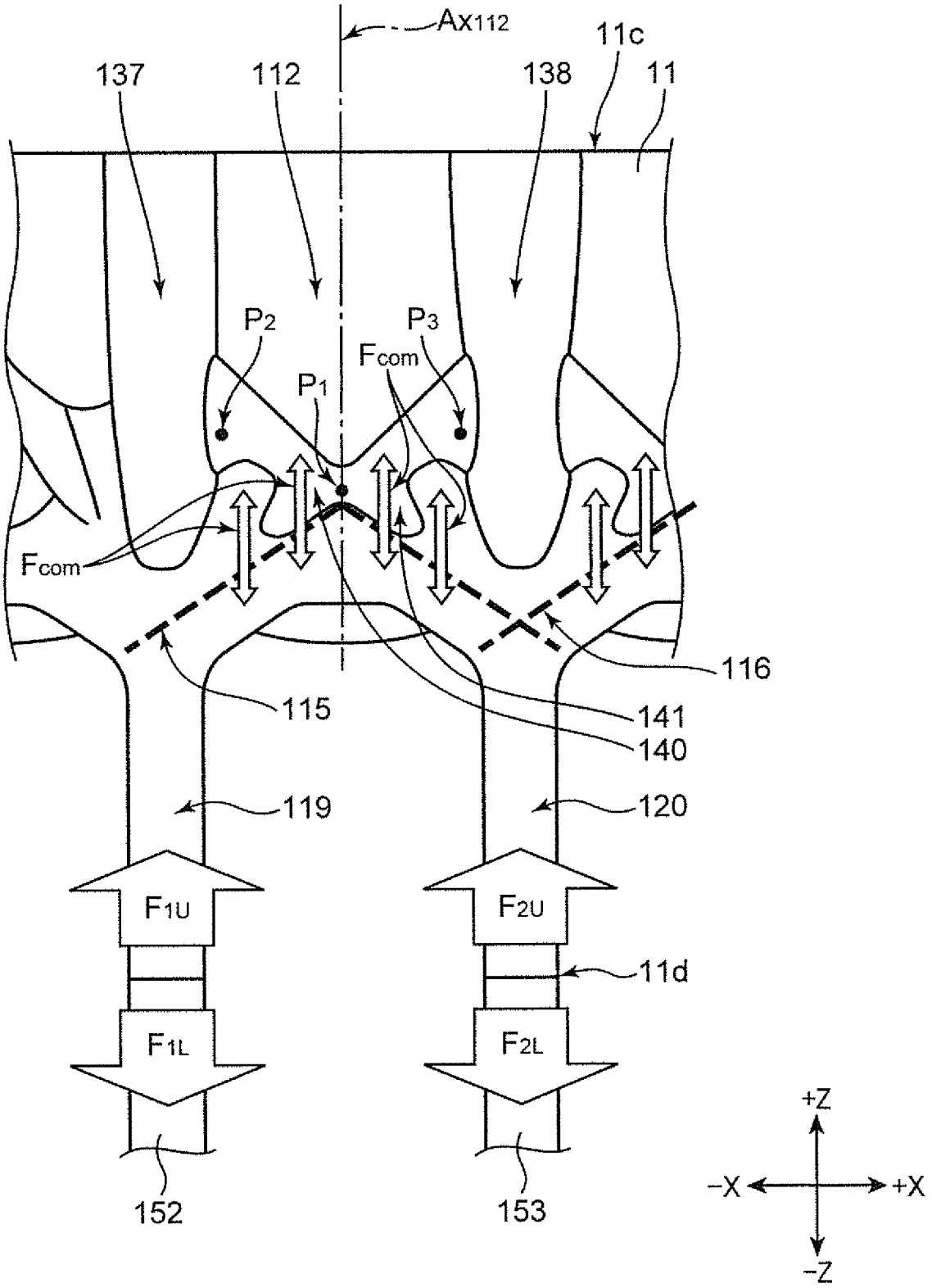
FIG. 9 is a schematic view illustrating transfer of forces from a shaft supporting part to a cylinder part.

Transfer of a force created by rotation of the crank shaft 16 will be described with reference to FIG. 9. FIG. 9 is a schematic view illustrating transfer of forces from the shaft supporting parts 119 and 120 to the cylinder part 112.

As illustrated in FIG. 9, forces $F_{1U}$ and $F_{2U}$ and forces $F_{1L}$ and $F_{2L}$ corresponding to a phase angle of the crank shaft 16 (not shown in FIG. 9) act on the shaft supporting parts 119 and 120. The forces $F_{1U}$ and $F_{2U}$ are compressional forces that act toward +Z side, and the forces $F_{1L}$ and $F_{2L}$ are tension forces that act toward −Z side. The tension forces $F_{1L}$ and $F_{2L}$ act on the shaft supporting parts 119 and 120 as the force of the crank shaft 16 acting on the bearing caps 152 and 153 is transferred to the shaft supporting parts 119 and 120 via the contact faces 11*d*, which contact the bearing caps 152 and 153, of the shaft supporting parts 119 and 120.

The forces $F_{1U}$ and $F_{2U}$ and the forces $F_{1L}$ and $F_{2L}$ are transferred from the shaft supporting parts 119 and 120 to the connecting portions 115 and 116. Portions of the forces $F_{1U}$ and $F_{2U}$ and the forces $F_{1L}$ and $F_{2L}$ transferred to the connecting portions 115 and 116 are transferred toward +Z side via the head bolt hole bases 137 and 138 and peripheral portions thereof.

Remaining portions of the forces $F_{1U}$ and $F_{2U}$ and the forces $F_{1L}$ and $F_{2L}$ transferred to the connecting portions 115 and 116 are transferred along the diagonal ribs 140 and 141. The forces transferred along the diagonal ribs 140 and 141 are distributed to a region between the head bolt hole base 137 and the head bolt hole base 138 (partial region of the side wall face of the inner cylinder part 112) to be transferred toward +Z side (force $F_{com}$).

The force transferred along the diagonal rib 140 and the force transferred along the diagonal rib 141 once concentrate at the intersection point $P_1$. Similarly to the manner described above, even when there is a variation between the force transferred from the connecting portion 115 to the intersection point $P_1$ along the diagonal rib 140 and the force transferred from the connecting portion 116 to the intersection point $P_1$ along the diagonal rib 141, the forces are once concentrated at the intersection point $P_1$ and evenly distributed.

Portions of the forces transferred along the diagonal ribs 140 and 141 are transferred to the head bolt hole bases 137 and 138 via the junction points $P_2$ and $P_3$.

8. Effect

In the engine 1 according to the present embodiment, the side wall faces of the inner cylinder parts 112 and 113 are provided with the diagonal rib 140 that diagonally extends. The diagonal rib 140 is formed from the connecting portion 116 to the head bolt hole base 137. As described with reference to FIG. 8, in the engine 1 according to the present embodiment, the compressional stress $Sc_2$ created by fastening with the head bolts 20 is distributed by the diagonal rib 140 to the region where the diagonal rib 140 extends on the side wall face of the inner cylinder part 112. In the engine 1 according to the present embodiment, the compressional stress $Sc_2$ created by fastening with the head bolts 20 is distributed along the circumferential direction in the regions of the side wall faces of the inner cylinder parts 112 and 113 where the diagonal rib 140 is provided, resulting in the compressional stress acting on the contact face 11*c*, which contacts the cylinder head 13, of the block core 11.

In the engine 1 according to the present embodiment, high sealability can be obtained between the block core 11 of the cylinder block 10 and the cylinder head 13 regardless of a distance from the fastener portion where the head bolt 20 exists.

In the engine 1 according to the present embodiment, as described with reference to FIG. 6, the side wall faces of the inner cylinder parts 112 and 113 are provided with the diagonal rib 141 in addition to the diagonal rib 140, so that the compressional stress $Sc_1$ created by fastening with the head bolts 20 is distributed by the diagonal rib 141 not only near the head bolt holes in the inner cylinder parts 112 and 113 but also to a region between the head bolt hole bases 137 and 138 on the side wall face. In the engine 1 according to the present embodiment, the compressional stress $Sc_1$ created by fastening with the head bolts 20 is distributed to the regions where the diagonal rib 141 extends on the side wall faces of the inner cylinder parts 112 and 113, resulting in the distributed compressional stress $Sc_{11}$ acting on the contact face 11*c*, which contacts the cylinder head 13, of the block core 11 of the cylinder block 10.

In the engine 1 according to the present embodiment, the diagonal rib 140 and the diagonal rib 141 intersect each other at the intersection point $P_1$, so that the compressional stresses acting near the head bolt hole bases 137 and 138 of the inner cylinder parts 112 and 113 are transferred along the regions where the diagonal rib 140 and the diagonal rib 141 extend and are once concentrated at the intersection point $P_1$. The concentrated stress at the intersection point $P_1$ is distributed by the diagonal ribs 140 and 141 along the circumferential direction in the side wall faces of the inner cylinder parts 112 and 113. In the engine 1 according to the present embodiment, the compressional stress in the inner cylinder parts 112 and 113 is more reliably distributed to a portion further in +Z side ($Sc_1$ and $Sc_2$) than regions where the diagonal rib 140 and 141 are provided.

As illustrated in FIG. 6, in the engine 1 according to the present embodiment, the intersection point $P_1$ where the diagonal rib 140 and the diagonal rib 141 intersect each other is located in −Z side at the distance $H_1$ from the contact face 11*c*, which contacts the cylinder head 13, of the block core 11, so that occurrence of stress concentration at a particular place on the contact face 11*c* can be suppressed. That is, if an embodiment has an intersection point between the diagonal ribs on the contact face, the stress concentrates at the intersection point on the contact face and causes an uneven contact pressure distribution along the circumferential direction on the contact face, which leads to deterioration in sealability.

In the engine 1 according to the present embodiment, the intersection point $P_1$ is located further in −Z side than the contact face 11*c*, which contacts the cylinder head 13, of the block core 11, so that occurrence of an uneven contact pressure distribution on the contact face 11*c* can be suppressed, resulting in high sealability between the block core 11 and the cylinder head 13.

In the engine 1 according to the present embodiment, the configuration having the diagonal ribs 140 and 141 respectively joined to the head bolt hole bases 137 and 138 provides a high rigidity to the side walls of the inner cylinder parts 112 and 113 in addition to high sealability between the block core 11 and the cylinder head 13. Accordingly, the block core 11 according to the present embodiment can have a sufficient rigidity, even when portions of the inner cylinder parts 112 and 113 other than the diagonal ribs 140 and 141 have smaller thickness, and therefore is suitable for reducing weight of the engine 1.

In the engine 1 according to the present embodiment, the junction point $P_3$ between the diagonal rib 140 and the head bolt hole base 138 and the junction point $P_2$ between the diagonal rib 141 and the head bolt hole base 137 are located in −Z side at a distance $H_2$ from the contact face 11*c*, which contacts the cylinder head 13, of the block core 11, and this suppresses occurrence of an uneven contact pressure distribution on the contact face 11*c* by the stresses $Sc_9$ and $Sc_{10}$ transferred along the diagonal ribs 140 and 141. That is, the diagonal ribs 140 and 141 can cause the stress $Sc_{12}$ distributed along the circumferential direction of the inner cylinder parts 112 and 113 to act on the contact face 11*c*.

In the engine 1 according to the present embodiment, the end portions 152*a* and 153*a* of the bearing cap 15 are free ends as illustrated in FIG. 6, and the forces $F_{1U}$, $F_{1L}$, $F_{2U}$, and $F_{2L}$ in Z direction created by rotation of the crank shaft 16 are transferred to the cylinder parts 111 to 114 via the connecting portions 115 and 116 as illustrated in FIG. 8. Also in this case, in the engine 1 according to the present embodiment, the diagonal ribs 140 and 141 provided on the side wall faces of the inner cylinder parts 112 and 113 distribute the force acting on the contact face 11*c*, which contacts cylinder head 13, of the block core 11 and thus high sealability is obtained.

In the engine 1 according to the present embodiment, the block core 11 is held between the cylinder head 13 and the bearing cap 15 by screwing the head bolts 20 in the female threads of the threaded holes 15*a* in the bearing cap 15. Such a configuration creates high compressional stresses near the head bolt hole bases 137 and 138. In the engine 1 according to the present embodiment, the diagonal ribs 140 and 141 formed on the side wall faces of the inner cylinder parts 112 and 113 as described above distribute the stresses along the circumferential direction of the inner cylinder parts 112 and 113, and thereby local stress concentration on the contact face 11*c* can be avoided. Accordingly, the engine 1 according to the present embodiment has higher sealability between the block core 11 and the cylinder head 13.

As described with reference to FIG. 1, the engine according to the present embodiment includes the cylinder block outer wall 12 formed using a resin material, so that the weight of the engine 1 can further be reduced as compared to the case of using a metal material for the whole cylinder block. While reducing the weight using the cylinder block outer wall 12 made of a resin material, higher sealability can be obtained by the diagonal ribs 140 and 141 formed on the side wall faces of the inner cylinder parts 112 and 113 as described above.

In the engine 1 according to the present embodiment as described above, high sealability can be obtained between the block core 1 of the cylinder block 10 and the cylinder head 13 regardless of the distance from the fastener portion where the head bolt 20 exists.

Exemplary Modification

In the engine 1 according to the above embodiment, the two diagonal ribs 140 and 141 are provided on each side wall face of the inner cylinder parts 112 and 113 of the block core 11. However, the present invention is not limited to such a configuration. For example, only one diagonal rib may be provided, or three or more diagonal ribs may be provided.

In the engine 1 according to the above embodiment, the diagonal rib 140 and the diagonal rib 141 intersect each other at the intersection point $P_1$. However, the present invention does not necessarily require the diagonal ribs to intersect each other.

In the engine 1 according to the above embodiment, the diagonal ribs 140 and 141 each having a straight shape in a side view viewed along Y direction are used. However, the present invention is not limited to such a configuration. For example, a rib having a curved shape in a side view may be used.

In the engine 1 according to the above embodiment, the lower end portions of the bearing caps 151 to 155 are free ends that are not joined to each other. However, the present invention is not limited to such a configuration. For example, the lower end portions of the bearing caps may be connected to each other by a beam member.

Furthermore, in the above embodiment, the head bolts 20 are inserted in the cylinder head 13 and the block core 11 to be screwed in the threaded holes 20*b* provided in the bearing cap 15. However, the present invention is not limited to such a configuration. For example, the head bolts may be inserted in the cylinder head, the block core, and the bearing cap to be screwed in nuts disposed below the bearing cap. Furthermore, the bolts inserted in the cylinder head may be screwed in the threaded holes provided in the block core while screwing the bolts inserted in the bearing cap from below in the threaded holes in the block core.

In the engine 1 according to the above embodiment, whether a head gasket is interposed between the cylinder head 13 and the cylinder block 10 is not particularly mentioned. However, a head gasket may be interposed between the cylinder head 13 and the cylinder block 10.

In the above embodiment described above, the engine 1 is an exemplary four-cylinder gasoline engine. However, the present invention is not limited to such a configuration. For example, the engine may have three, five, or more cylinders. The engine may be a diesel engine. The engine may be a horizontally opposed engine.

[Summary]

A multi-cylinder engine according to one aspect of the present invention includes an output shaft of the multi-cylinder engine, a cylinder head, a cylinder block attached to the cylinder head, and a plurality of head bolts for fastening together the cylinder block and the cylinder head. The cylinder block includes three or more cylinder parts each extending in a direction perpendicular to the output shaft and including a cylinder formed in the cylinder part, the three or more cylinder parts being formed in series, a plurality of connecting portions each provided at a portion where the cylinder parts adjacent along the output shaft axial direction are joined to each other, the connecting portions being disposed in a side opposite to the cylinder head in a cylinder axial direction, a plurality of output shaft supporting parts each provided on one of the plurality of connecting portions to extend in a side opposite to the cylinder part in the cylinder axial direction, each of the plurality of output shaft supporting parts including a portion that supports the output shaft, and a plurality of head bolt holes each provided in a portion of a side wall of the three or more cylinder parts, the portion being where the cylinder parts adjacent along the output shaft axial direction are joined to each other, the head bolt holes extending in the cylinder axial direction from a contact face, which contacts the cylinder head, toward the connecting portion, the plurality of head bolts being inserted in the plurality of head bolt holes, and wherein a side wall face of at least one of the three or more cylinder parts includes a first rib extending diagonally to the cylinder axial direction toward the cylinder head, the first rib having a proximal end on the connecting portion provided in one side, in the output shaft axial direction, of the cylinder part and extending to the head bolt hole provided in the other side, in the output shaft axial direction, of the cylinder part.

In the multi-cylinder engine according to the above aspect, the side wall face of the at least one cylinder part is provided with the first rib that diagonally extends. The first rib is formed from the connecting portion to the head bolt hole. Thus, in the multi-cylinder engine according to the above aspect, the compressional stress created by fastening with the head bolts is distributed by the first rib to the region where the first rib extends on the side wall face of the cylinder part. Thus, in the multi-cylinder engine according to the above aspect, the compressional stress created by fastening with the head bolts is distributed along the circumferential direction in the region where the first rib is provided on the side wall face of the cylinder part, resulting in the compressional stress acting on the contact face, which contacts the cylinder head, of the cylinder block.

Accordingly, in the multi-cylinder engine according to the above aspect, high sealability can be obtained between the cylinder block and the cylinder head regardless of the distance from the portion where the head bolt hole is provided.

In the multi-cylinder engine according to the above aspect, the side wall face of the cylinder part including the first rib may include a second rib extending diagonally to the cylinder axial direction toward the cylinder head, the second rib having a proximal end on the connecting portion provided in the other side, in the output shaft axial direction, of the cylinder part and extending to the head bolt hole provided in the one side, in the output shaft axial direction, of the cylinder part.

In the multi-cylinder engine described above, the side wall faces, provided with the first rib, of the cylinder part is also provided with the second rib that diagonally extends, so that the compressional stress created by fastening with the head bolts is distributed not only near the head bolt hole in the cylinder part but also to the region of the side wall face between the head bolt holes adjacent along the output shaft axial direction by the second rib. Thus, in the multi-cylinder engine according to the above aspect, the compressional stress created by fastening with the head bolts is distributed along the circumferential direction in the region where the second rib extends on the side wall face of the cylinder part, resulting in the distributed compressional stress acting on the contact face, which contacts the cylinder head, of the cylinder block.

Accordingly, in the multi-cylinder engine according to the above aspect, high sealability can more reliably be obtained between the cylinder block and the cylinder head regardless of the distance from the fastener portion where the head bolt hole is provided.

In the multi-cylinder engine according to the above aspect, the first rib and the second rib may be provided to intersect each other between the head bolt hole in the one side and the head bolt hole in the other side.

In the multi-cylinder engine described above, the first rib and the second rib intersect each other, so that the compressional stresses acting near the end portions, in the output shaft axial direction, of the cylinder part are transferred along the regions where the first rib and the second rib extend, which causes the stresses to once concentrate at the point where the first rib and the second rib intersect each other. The stress concentrated at the intersection point is distributed by the first rib and the second rib along the circumferential direction in the side wall face of the cylinder part. Thus, in the multi-cylinder engine according to the above aspect, the compressional stress is more reliably distributed to the portion of the cylinder part further in the upper side than the first rib and the second rib.

In the multi-cylinder engine according to the above aspect, a point where the first rib and the second rib intersect each other may be located closer to the connecting portion than to the contact face in the cylinder axial direction.

In the multi-cylinder engine described above, the point where the first rib and the second rib intersect each other is located closer to the connecting portion in the cylinder axial direction than to the contact face, which contacts the cylinder head, of the cylinder block, so that occurrence of stress concentration at a particular place on the contact face can be suppressed. That is, if an embodiment has an intersection point where the first rib and the second rib intersect each other on the contact face, the stress concentration at the intersection point on the contact face causes an uneven contact pressure distribution along the output shaft axial direction on the contact face, which leads to deterioration in sealability.

On the other hand, in the multi-cylinder engine described above, the point where the first rib and the second rib intersect each other is located closer to the connecting portion in the cylinder axial direction than to the contact face, which contacts the cylinder head, of the cylinder block, so that occurrence of an uneven contact pressure distribution on the contact face can be suppressed, which leads to high sealability.

In the multi-cylinder engine according to the above aspect, the side wall faces of the three or more cylinder parts may each include a head bolt hole base having a form of a circular-column rib in a portion where the cylinder parts adjacent along the output shaft axial direction are joined to each other, each of the plurality of head bolt holes may be provided in an inner portion of one of the plurality of head bolt hole bases, the first rib may be joined to the head bolt hole base disposed in the other side in the output shaft axial direction, and the second rib may be joined to the head bolt hole base disposed in the one side in the output shaft axial direction.

In the multi-cylinder engine described above, the first rib and the second rib are each joined to the head bolt hole base, so that a high rigidity is provided to the side wall of the inner cylinder part in addition to high sealability between the cylinder block and the cylinder head. Accordingly, the multi-cylinder engine described above can have a sufficient rigidity, even when the portions of the cylinder part other than the first rib and the second rib have smaller thicknesses, and therefore is suitable for reducing weight of the engine.

In the multi-cylinder engine according to the above aspect, a junction point where the first rib is joined to the head bolt hole base in the other side and a junction point where the second rib is joined to the head bolt hole base in the one side may be located closer to the connecting portion than to the contact face in the cylinder axial direction.

In the multi-cylinder engine described above, the junction points where the first rib and the second rib are joined to the head bolt hole bases are located closer to the connecting portion in the cylinder axial direction than to the contact face, which contacts the cylinder head, of the cylinder block, and this suppresses occurrence of an uneven contact pressure distribution on the contact face by the stresses transferred along the first rib and the second rib. That is, the first rib and the second rib can cause the stress distributed along the circumferential direction of the cylinder part to act on the contact face.

The multi-cylinder engine according to the above aspect may include a plurality of cap parts each provided in a side opposite to the cylinder part in the cylinder axial direction to be joined to one of the plurality of output shaft supporting parts, the plurality of cap parts each including a portion that supports the output shaft, in which end portions of the plurality of cap parts in the side opposite to the output shaft supporting parts in the cylinder axial direction may not be connected to each other, the end portions each being a free end.

In the multi-cylinder engine described above, the end portion of the cap part (end portion in a side opposite to the output shaft supporting part) is a free end, so that the force created by rotation of the output shaft to act in the cylinder axial direction (vertical force) is transferred to the cylinder part via the connecting portion. Also in this case, in the multi-cylinder engine according to the above aspect, the first rib provided on the side wall faces of the cylinder parts can distribute the force acting on the contact face, which contacts the cylinder head, of the cylinder block, and thus high sealability can be obtained.

In the multi-cylinder engine according to the above aspect, each of the plurality of head bolt holes may penetrate the cylinder block in the cylinder axial direction from the contact face to the end portion of the output shaft supporting part, the end portion being close to the cap part, each of the plurality of cap parts may include a threaded hole communicating with the head bolt hole, the head bolt being screwed in the threaded hole, and the cylinder block may be tightly held by the cylinder head and the cap part by means of screwing the plurality of head bolts in female threads of the threaded holes.

In the multi-cylinder engine described above, the cylinder block is held between the cylinder head and the cap part by screwing the head bolts in the female threads of the threaded holes in the cap part. Such a configuration creates a high compressional stress near the head bolt hole base. In the multi-cylinder engine according to the above aspect, the first rib formed on the side wall face of the inner cylinder part as described above distributes the stress along the circumferential direction of the side face wall of the cylinder part to suppress occurrence of local stress concentration on the contact face. Accordingly, the multi-cylinder engine according to the above aspect is provided with higher sealability.

In the multi-cylinder engine according to the above aspect, the cylinder block may further include a cylinder block outer wall surrounding the three or more cylinder parts, the plurality of output shaft supporting parts, and the plurality of cap parts, the three or more cylinder parts, the plurality of connecting portions, and the plurality of output shaft supporting parts may be integrally formed using a metal material, and the cylinder block outer wall may be formed using a resin material.

The multi-cylinder engine described above includes the cylinder block outer wall formed using a resin material, so that the weight of the engine can further be reduced as compared to a case of using a metal material for the whole cylinder block. While reducing the weight by using the cylinder block outer wall made of a resin material, high sealability between the cylinder head and the cylinder block can be obtained by the first rib formed on the side wall face of the inner cylinder part as described above.

In the multi-cylinder engine according to the above aspect, the cylinder part provided with the first rib may be an inner cylinder part among the three cylinder parts, namely the cylinder part other than the cylinder parts disposed at the ends in the output shaft axial direction.

In the multi-cylinder engine described above, the side wall face of the inner cylinder part is provided with the first rib, so that high sealability can be obtained between the inner cylinder part and the cylinder head.

As described above, in the multi-cylinder engine described above, high sealability can be obtained between the cylinder block and the cylinder head regardless of the distance from the portion where the head bolt hole is provided.

The invention claimed is:

1. A multi-cylinder engine comprising:

an output shaft of the multi-cylinder engine;

a cylinder head;

a cylinder block attached to the cylinder head; and a plurality of head bolts for fastening together the cylinder block and the cylinder head, wherein the cylinder block includes three or more cylinder parts each extending in a direction perpendicular to the output shaft and including a cylinder formed therein, the three or more cylinder parts being formed in series, a plurality of connecting portions each provided at a portion where the cylinder parts adjacent along the output shaft axial direction are joined to each other so as to connect the adjacent cylinder parts, the connecting portions being disposed in a side opposite to the cylinder head in a cylinder axial direction, a plurality of output shaft supporting parts each provided on one of the plurality of connecting portions to extend in a side opposite to the cylinder part in the cylinder axial direction, each of the plurality of output shaft supporting parts including a portion that supports the output shaft, and a plurality of head bolt holes each provided in a portion of a side wall of the three or more cylinder parts, the portion being where the cylinder parts adjacent along the output shaft axial direction are joined to each other, the head bolt holes extending in the cylinder axial direction from a contact face, which contacts the cylinder head, toward the connecting portion, the plurality of head bolts being inserted in the plurality of head bolt holes, and wherein a side wall face of at least one of the three or more cylinder parts includes a first rib extending diagonally to the cylinder axial direction toward the cylinder head, the first rib having a proximal end on the connecting portion provided in one side, in the output shaft axial direction, of the cylinder part and extending to the head bolt hole provided in the other side, in the output shaft axial direction, of the cylinder part, each of the connecting portions is provided below a head bolt hole base in which a head bolt hole is formed, and extends outward with respect to the head bolt hole base in a radial direction of the cylinder parts, and the first rib extends in the radial direction of the cylinder parts.

2. The multi-cylinder engine according to claim 1, wherein the side wall face of the cylinder part including the first rib includes a second rib extending diagonally to the cylinder axial direction toward the cylinder head, the second rib having a proximal end on the connecting portion provided in the other side, in the output shaft axial direction, of the cylinder part and extending to the head bolt hole provided in the one side, in the output shaft axial direction, of the cylinder part.

3. The multi-cylinder engine according to claim 2, wherein the first rib and the second rib are provided to intersect each other between the head bolt hole in the one side and the head bolt hole in the other side.

4. The multi-cylinder engine according to claim 3, wherein a point where the first rib and the second rib intersect each other is located closer to the connecting portion than to the contact face in the cylinder axial direction.

5. The multi-cylinder engine according to claim 2, wherein the side wall faces of the three or more cylinder parts each includes a head bolt hole base having a form of a circular-column rib in a portion where the cylinder parts adjacent along the output shaft axial direction are joined to each other, each of the plurality of head bolt holes is provided in an inner portion of one of the plurality of head bolt hole bases, the first rib is joined to the head bolt hole base disposed in the other side in the output shaft axial direction, and the second rib is joined to the head bolt hole base disposed in the one side in the output shaft axial direction.

6. The multi-cylinder engine according to claim 5, wherein a junction point where the first rib is joined to the head bolt hole base in the other side and a junction point where the second rib is joined to the head bolt hole base in the one side are located closer to the connecting portion than to the contact face in the cylinder axial direction.

7. The multi-cylinder engine according to claim 1, further comprising a plurality of cap parts each provided in a side opposite to the cylinder part in the cylinder axial direction to be joined to one of the plurality of output shaft supporting parts, the plurality of cap parts each including a portion that supports the output shaft, wherein end portions of the plurality of cap parts in the side opposite to the output shaft supporting parts in the cylinder axial direction are not connected to each other, the end portions each being a free end.

8. The multi-cylinder engine according to claim 7, wherein each of the plurality of head bolt holes penetrates the cylinder block in the cylinder axial direction from the contact face to the end portion of the output shaft supporting part, the end portion being close to the cap part, each of the plurality of cap parts includes a threaded hole communicating with the head bolt hole, one of the head bolts being screwed in the threaded hole, and the cylinder block is tightly held by the cylinder head and the cap part by means of screwing the plurality of head bolts in female threads of the threaded holes.

9. The multi-cylinder engine according to claim 1, wherein the cylinder block further includes a cylinder block outer wall surrounding the three or more cylinder parts, the plurality of output shaft supporting parts, and the plurality of cap parts, the three or more cylinder parts, the plurality of connecting portions, and the plurality of output shaft supporting parts are integrally formed using a metal material, and the cylinder block outer wall is formed using a resin material.

10. The multi-cylinder engine according to claim 1, wherein the cylinder part including the first rib is an inner cylinder part among the three or more cylinder parts, the inner cylinder part being a cylinder part other than the cylinder parts disposed at ends in the output shaft axial direction.

11. The multi-cylinder engine according to claim 3, wherein the side wall faces of the three or more cylinder parts each includes a head bolt hole base having a form of a circular-column rib in a portion where the cylinder parts adjacent along the output shaft axial direction are joined to each other, each of the plurality of head bolt holes is provided in an inner portion of one of the plurality of head bolt hole bases, the first rib is joined to the head bolt hole base disposed in the other side in the output shaft axial direction, and the second rib is joined to the head bolt hole base disposed in the one side in the output shaft axial direction.

12. The multi-cylinder engine according to claim 4, wherein the side wall faces of the three or more cylinder parts each includes a head bolt hole base having a form of a circular-column rib in a portion where the cylinder parts adjacent along the output shaft axial direction are joined to each other, each of the plurality of head bolt holes is provided in an inner portion of one of the plurality of head bolt hole bases, the first rib is joined to the head bolt hole base disposed in the other side in the output shaft axial direction, and the second rib is joined to the head bolt hole base disposed in the one side in the output shaft axial direction.

13. The multi-cylinder engine according to claim 2, further comprising a plurality of cap parts each provided in a side opposite to the cylinder part in the cylinder axial direction to be joined to one of the plurality of output shaft supporting parts, the plurality of cap parts each including a portion that supports the output shaft, wherein end portions of the plurality of cap parts in the side opposite to the output shaft supporting parts in the cylinder axial direction are not connected to each other, the end portions each being a free end.

14. The multi-cylinder engine according to claim 3, further comprising a plurality of cap parts each provided in a side opposite to the cylinder part in the cylinder axial direction to be joined to one of the plurality of output shaft supporting parts, the plurality of cap parts each including a portion that supports the output shaft, wherein end portions of the plurality of cap parts in the side opposite to the output shaft supporting parts in the cylinder axial direction are not connected to each other, the end portions each being a free end.

15. The multi-cylinder engine according to claim 4, further comprising a plurality of cap parts each provided in a side opposite to the cylinder part in the cylinder axial direction to be joined to one of the plurality of output shaft supporting parts, the plurality of cap parts each including a portion that supports the output shaft, wherein end portions of the plurality of cap parts in the side opposite to the output shaft supporting parts in the cylinder axial direction are not connected to each other, the end portions each being a free end.

16. The multi-cylinder engine according to claim 5, further comprising a plurality of cap parts each provided in a side opposite to the cylinder part in the cylinder axial direction to be joined to one of the plurality of output shaft supporting parts, the plurality of cap parts each including a portion that supports the output shaft, wherein end portions of the plurality of cap parts in the side opposite to the output shaft supporting parts in the cylinder axial direction are not connected to each other, the end portions each being a free end.

17. The multi-cylinder engine according to claim 1, wherein the first rib has a proximal end on a first connecting portion of the plurality of connecting portions, extends in an oblique direction which faces forward in the output shaft axial direction and one side in the cylinder axial direction, and joins a first head bolt hole base in which a head bolt hole is formed, the side wall face of the cylinder part further includes a second rib different from the first rib, and the second rib has a proximal end on a second connecting portion adjacent to the first connecting portion, extends in an oblique direction which faces rearward in the output shaft axial direction and the one side in the cylinder axial direction, and joins a second head bolt hole base adjacent to the first head bolt hole base.

18. The multi-cylinder engine according to claim 17, wherein the first rib and the second rib join respective lower portions of the first head bolt hole base and the second head bolt hole base.

19. A multi-cylinder engine comprising:

an output shaft of the multi-cylinder engine;

a cylinder head;

a cylinder block attached to the cylinder head; and a plurality of head bolts for fastening together the cylinder block and the cylinder head, wherein the cylinder block includes three or more cylinder parts each extending in a direction perpendicular to the output shaft and including a cylinder formed therein, the three or more cylinder parts being formed in series, a plurality of connecting portions each provided at a portion where the cylinder parts adjacent along the output shaft axial direction are joined to each other so as to connect the adjacent cylinder parts, the connecting portions being disposed in a side opposite to the cylinder head in a cylinder axial direction, a plurality of output shaft supporting parts each provided on one of the plurality of connecting portions to extend in a side opposite to the cylinder part in the cylinder axial direction, each of the plurality of output shaft supporting parts including a portion that supports the output shaft, and a plurality of head bolt holes each provided in a portion of a side wall of the three or more cylinder parts, the portion being where the cylinder parts adjacent along the output shaft axial direction are joined to each other, the head bolt holes extending in the cylinder axial direction from a contact face, which contacts the cylinder head, toward the connecting portion, the plurality of head bolts being inserted in the plurality of head bolt holes, and wherein a side wall face of at least one of the three or more cylinder parts includes a first rib extending diagonally to the cylinder axial direction toward the cylinder head, the first rib having a proximal end on the connecting portion provided in one side, in the output shaft axial direction, of the cylinder part and extending to the head bolt hole provided in the other side, in the output shaft axial direction, of the cylinder part, each of the connecting portions is provided below a head bolt hole base in which a head bolt hole is formed, and extends outward with respect to the head bolt hole base in a radial direction of the cylinder parts, and the side wall face of the cylinder part including the first rib includes a second rib extending diagonally to the cylinder axial direction toward the cylinder head, the second rib having a proximal end on the connecting portion provided in the other side, in the output shaft axial direction, of the cylinder part and extending to the head bolt hole provided in the one side, in the output shaft axial direction, of the cylinder part.

20. A multi-cylinder engine comprising:

an output shaft of the multi-cylinder engine;

a cylinder head;

a cylinder block attached to the cylinder head; and a plurality of head bolts for fastening together the cylinder block and the cylinder head, wherein the cylinder block includes three or more cylinder parts each extending in a direction perpendicular to the output shaft and including a cylinder formed therein, the three or more cylinder parts being formed in series, a plurality of connecting portions each provided at a portion where the cylinder parts adjacent along the output shaft axial direction are joined to each other so as to connect the adjacent cylinder parts, the connecting portions being disposed in a side opposite to the cylinder head in a cylinder axial direction, a plurality of output shaft supporting parts each provided on one of the plurality of connecting portions to extend in a side opposite to the cylinder part in the cylinder axial direction, each of the plurality of output shaft supporting parts including a portion that supports the output shaft, a plurality of head bolt holes each provided in a portion of a side wall of the three or more cylinder parts, the portion being where the cylinder parts adjacent along the output shaft axial direction are joined to each other, the head bolt holes extending in the cylinder axial direction from a contact face, which contacts the cylinder head, toward the connecting portion, the plurality of head bolts being inserted in the plurality of head bolt holes, and a plurality of cap parts each provided in a side opposite to the cylinder part in the cylinder axial direction to be joined to one of the plurality of output shaft supporting parts, the plurality of cap parts each including a portion that supports the output shaft, wherein a side wall face of at least one of the three or more cylinder parts includes a first rib extending diagonally to the cylinder axial direction toward the cylinder head, the first rib having a proximal end on the connecting portion provided in one side, in the output shaft axial direction, of the cylinder part and extending to the head bolt hole provided in the other side, in the output shaft axial direction, of the cylinder part, end portions of the plurality of cap parts in the side opposite to the output shaft supporting parts in the cylinder axial direction are not connected to each other, the end portions each being a free end, each of the connecting portions is provided below a head bolt hole base in which a head bolt hole is formed, and extends outward with respect to the head bolt hole base in a radial direction of the cylinder parts, each of the plurality of head bolt holes penetrates the cylinder block in the cylinder axial direction from the contact face to the end portion of the output shaft supporting part, the end portion being close to the cap part, each of the plurality of cap parts includes a threaded hole communicating with the head bolt hole, one of the head bolts being screwed in the threaded hole, and the cylinder block is tightly held by the cylinder head and the cap part by means of screwing the plurality of head bolts in female threads of the threaded holes.

* * * * *